US007066868B2

(12) United States Patent
Van Den Heever

(10) Patent No.: US 7,066,868 B2
(45) Date of Patent: Jun. 27, 2006

(54) EXERCISE APPARATUS

(75) Inventor: Barend J. Van Den Heever, Winter Garden, FL (US)

(73) Assignee: Rockfit Industries, LLC, Winter Garden, FL (US)

( * ) Notice: Subject to any disclaimer, the term of this patent is extended or adjusted under 35 U.S.C. 154(b) by 22 days.

(21) Appl. No.: 10/613,436

(22) Filed: Jul. 7, 2003

(65) Prior Publication Data

US 2005/0009675 A1 Jan. 13, 2005

(51) Int. Cl.
*A63B 26/00* (2006.01)

(52) U.S. Cl. ..... 482/142; D21/823

(58) Field of Classification Search ..... 482/140–148, 482/96, 70–79, 51–54; 446/323; 472/118–119, 472/125; D21/823; 397/258.1; 434/255
See application file for complete search history.

(56) References Cited

U.S. PATENT DOCUMENTS

| | | | | |
|---|---|---|---|---|
| 281,216 | A | 7/1883 | White | |
| 2,729,271 | A | 1/1956 | Hayes | |
| 4,502,682 | A * | 3/1985 | Miller | 482/144 |
| 4,569,517 | A | 2/1986 | Smith | |
| 5,470,298 | A | 11/1995 | Curtis | |
| 5,595,558 | A | 1/1997 | Moon | |
| 5,599,257 | A * | 2/1997 | Lee | 482/51 |
| 5,674,161 | A * | 10/1997 | Lin | 482/96 |
| 5,695,438 | A | 12/1997 | Bjornsti | |
| 5,722,917 | A | 3/1998 | Olschansky et al. | |
| 5,899,836 | A | 5/1999 | Chen | |
| 6,110,018 | A * | 8/2000 | Hepworth | 451/48 |
| 6,500,072 | B1 * | 12/2002 | Myers et al. | 472/119 |
| 6,605,024 | B1 * | 8/2003 | Stearns | 482/142 |
| 6,877,801 | B1 * | 4/2005 | Asbach et al. | 297/16.1 |
| 6,887,161 | B1 * | 5/2005 | Mahlstedt et al. | 472/119 |
| 2004/0157712 | A1 * | 8/2004 | Bodily et al. | |

* cited by examiner

*Primary Examiner*—Lori Amerson
(74) *Attorney, Agent, or Firm*—William M. Hobby, III

(57) ABSTRACT

An exercise apparatus utilizes a user's own weight as a load has a folding A-frame formed from two frame sections hinged together and being foldable on the hinge from a storage position to an operative position. A generally U-shaped swing portion is movably attached to one of the frame sections and has a seat attached thereto. A pair of arms, each having a handle, are attached to a generally-U-shaped swing portion and extend therefrom so that a person sitting in the generally U-shaped swing portion seat can grip the handles and move the swing portion with the person sitting therein to thereby exercise a person's arms. A leg exerciser is attached to one of the frame sections to allow a person seated in the seat to exercise his legs.

12 Claims, 4 Drawing Sheets

EXERCISE APPARATUS

BACKGROUND OF THE INVENTION

The present invention relates generally to exercise equipment and more particularly to an exercise equipment which utilizes a user's own weight as a resistant force.

The increased public interest in fitness and health has resulted in a great variety of exercise equipment available on the market. Each type of exercise equipment has its own specific function because it is designed to train one or more parts of the user's body. Most exercise equipment provides adjustable loads, such as weights, springs, or hydraulic and pneumatic cylinders to provide a force for the user to work against. Most prior art exercise devices are also large and bulky and require a significant amount of floor space. Moreover, prior art equipment is typically manufactured with numerous moving parts formed of tubular steel or the like and much of the equipment is designed for use in commercial fitness centers. To meet a demand for more convenient exercise equipment, manufacturer's have designed smaller units for residential use. These prior art devices are more convenient than the larger commercial devices but are frequently unattractive and too large to be placed in living areas of a home.

An object of the present invention is to provide a foldable exercise apparatus which utilizes the user's own weight as a load in training the user's muscles without any external loads being required which simplifies the structure of the exercise device. The exercise device of the present invention utilizes a frame which may be a folding A-frame which has a generally U-shaped swing portion movably attached thereto and having a seat thereon for a user. A pair of arms are attached to the U-shaped swing portion along the hinge axis so that a person can grip the handles on the arms and push and pull to move the U-shaped portion seat and user occupying the seat. A leg exerciser has a leg bar attached to the frame and positioned for the user to push the swing portion and the user to move the swing portion with his legs.

Prior art U.S. Patents for exercise devices can be seen in the Lin U.S. Pat. No. 5,674,161 for an exerciser utilizing a user's own weight as a load and has a seat, which can be raised and lowered with the arms and legs pushing and pulling on handles or foot pedals. The Curtis exercise apparatus U.S. Pat. No. 5,470,298 is an exercise apparatus formed in a chair but with an arm exercise and leg exercise station. The Moon U.S. Pat. No. 5,595,558 is an exerciser of the rower-type while the Bjornsti U.S. Pat. No. 5,695,438 is a training apparatus having a frame with wheels for supporting a user in the standing position while he moves the wheels and thus partially utilizes the user's weight for training. The Olschansky et al. U.S. Pat. No. 5,722,917 is a displaceable seat exercise system and allows the user to exercise the arms and legs. The legs are exercised by rotary displacement of a seat relative to a foot support so that a resistive force is formed by a combination of the user's own body weight and a resistance element. The Chen U.S. Pat. No. 5,899,836 is an exerciser for pulling and stepping exercises and has provisions for moving the seat up and down. The Smith U.S. Pat. No. 4,569,517 and the Hayes U.S. Pat. No. 2,729,271 and the White U.S. Pat. No. 281,216 each show swing type exercisers.

In contrast to these devices, the present exercise apparatus may be foldable from a simple A-frame structure and utilizes the user's own weight as the resistive force for the user to exercise his arms and legs and simplifies the operation and size of the exercise equipment.

SUMMARY OF THE INVENTION

An exercise apparatus utilizes a user's own weight as a load and has a folding A-frame formed from two frame sections hinged together and being foldable on the hinge between a storage position and an operative position. A generally U-shaped swing portion is movably attached to one of the frame sections and has a seat attached thereto. The seat may have back and foot supports. A pair of arms each having a handle are attached to a generally U-shaped swing portion and extend therefrom so that a person sitting in the generally U-shaped swing portion seat and gripping and moving the handles can move the U-shaped swing portion and the person sitting therein relative to the A-frame to thereby exercise a person's arms. A leg exerciser is attached to one of the frame sections and positioned for a person seated in the seat to exercise the legs by pushing on a leg exercise bar with the feet to move the person sitting in the U-shaped swing portion so that a folding arm and leg exerciser apparatus utilizes a person's own mass for exercising the arms and legs. The folding frame sections can have a locking link to lock them in an open position. The generally U-shaped swing portion is movably attached to one frame section at the end thereof and the other frame section is hinged to the one frame section. A pair of arms are adjustable attached to the generally U-shaped swing portion to thereby vary the position of the handles relative to the user occupying the seat. An alternate embodiment has a frame having a base frame portion and an angled upright frame portion for supporting a generally U-shaped swing portion movably attached to the upright frame section but otherwise operates in the same manner.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
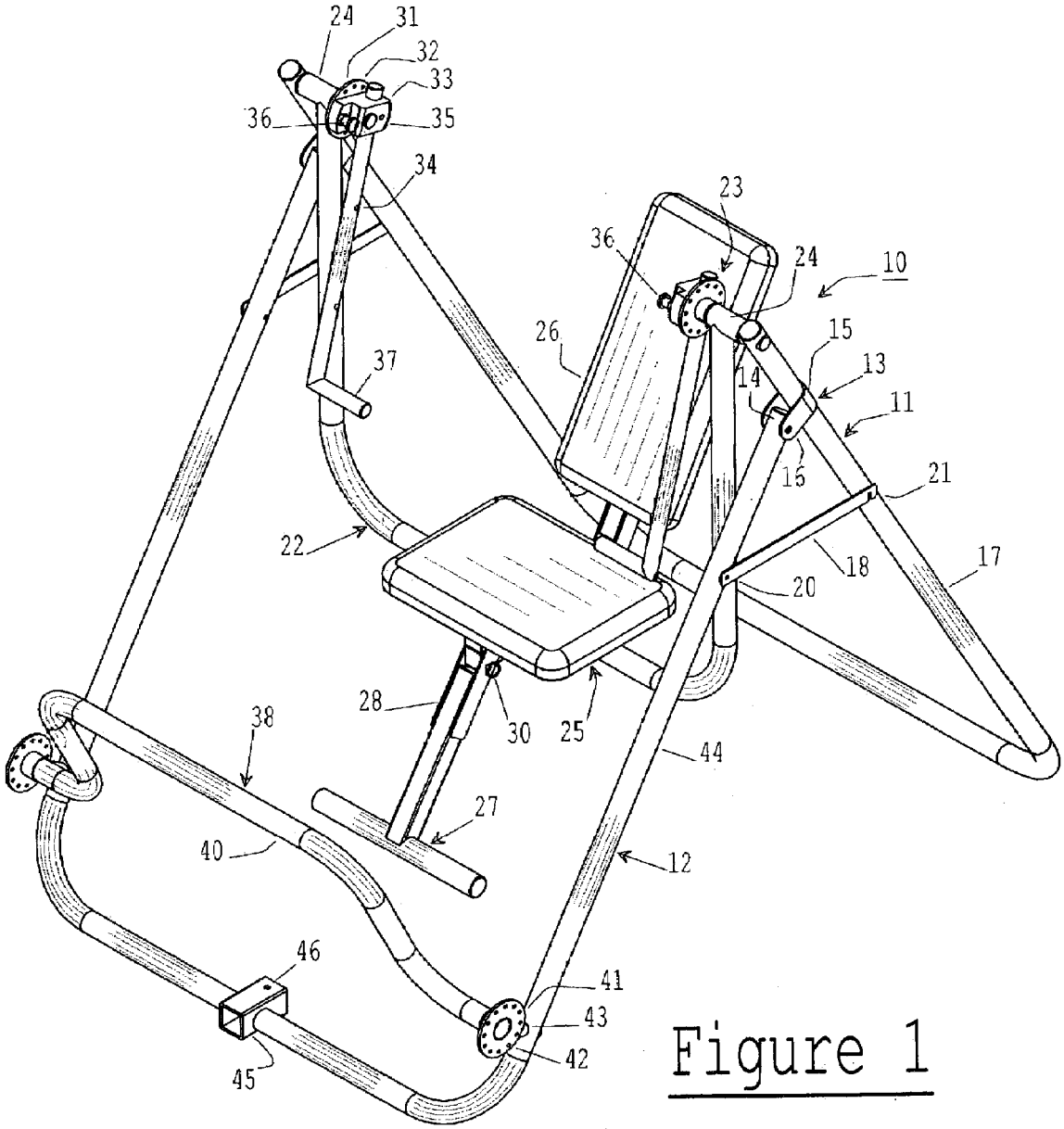
FIG. 1 is a perspective view of an exerciser in accordance with the present invention in an operative position.
Figure 2:
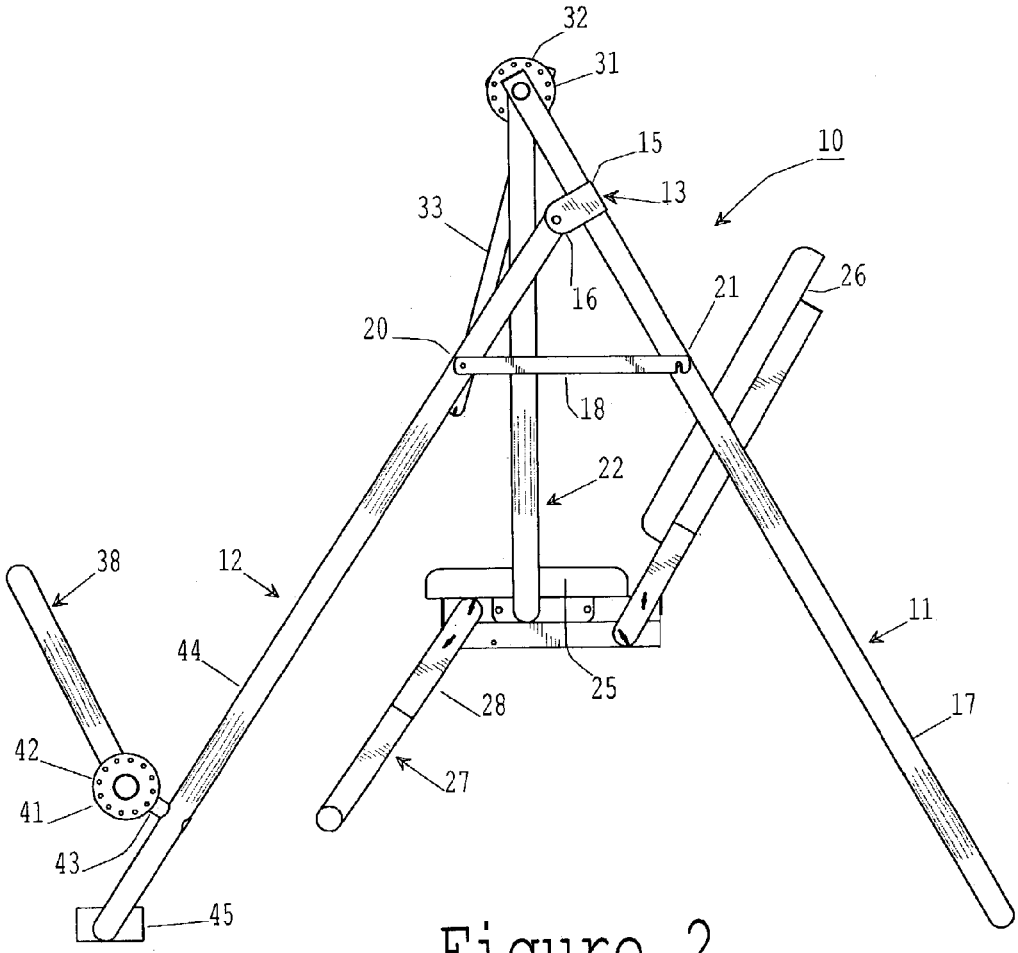
FIG. 2 is a side elevation of the exerciser of FIG. 1.
Figure 3:
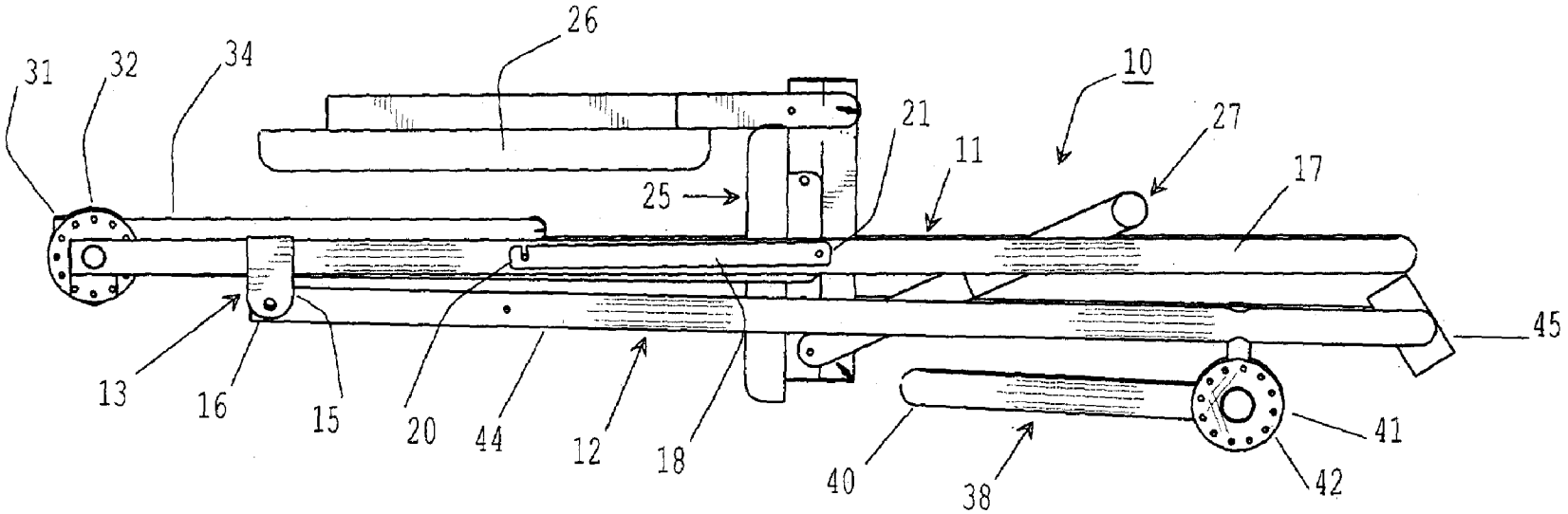
FIG. 3 is a side elevation of the exerciser of FIGS. 1 and 2 in a folded position.

Referring to the drawings of FIGS. 1–3, an exercise apparatus 10 is illustrated of the type using a user's own weight as a load has an A-frame shaped frame having frame sections 11 and 12 hinged together with a hinge 13. The frame sections 11 and 12 are both generally U-shaped frame sections. Frame section 12, ends 14 are connected to the hinge 13 which is in the form of a strap 15 having a hinge pin 16 mounted between the ends of the arms 17 of the frame section 11. When the A-frame is in an open position, as shown in FIGS. 1 and 2, a link member 18 locks the frame sections 11 and 12 together in an open position. One end of the link 18 is pinned with a pin 20 to the frame while the other end has a slot 21 which swings onto a pin positioned on the A-frame section 11. Swinging the arm 18 on the pin 20, unlocks the frame sections 11 and 12, and allows the A-frame section to be folded, as seen in FIG. 13.

A generally U-shaped swing portion 22 is formed of a tubular material and is hinged to the frame section 11 ends with a hinge 23 which includes a sleeve 24 rotating on a bar attached to the frame section 17. The U-shaped swing portion 22 has a seat 25 attached to the bottom of the U, which seat 25 has a backrest 26 attached thereto and a footrest 27 attached to the bottom thereof. Footrest 27 is removably attached to a yoke 28 and locking pin 30. The hinge 23 sleeve portion 24 on each side of the U-shaped swing portion 22 has a disc 31 attached thereto having a plurality of apertures 32 therein spaced around the periphery thereof.

An arm supporting bracket 33 supports an arm 34 and is attached to rotate on the bar 35. Each bracket 33 is locked to the locking disc 31 with a spring loaded pin 36 which can lock into any one of the plurality of apertures 32 in a disc 31 to position the extending arm 34 in different positions as desired. Each arm 34 has a handle 37 attached thereto. In this manner, a person sitting on the seat 25 on the U-shaped swing portion 22 can adjust the handle arms 34 to any position desired by rotating the arm and locking it to the disc 31 with the locking pin 36. The handle can then be pulled on to move the U-shaped swing portion 22 back and forth by pushing and pulling on the handles 37 while the user is sitting on the seat 25. Thus, the user pushes the swing portion 22, against the user's own weight.

The A-frame section 12 has a leg exerciser portion 38 attached thereto which includes a foot bar 40 which may have a disc 41 attached to each end, each disc 41 has a plurality of apertures 42 therein around the periphery thereof and which is attached to the frame section 12 with a bar 43 and which is further attached to the foot bar 40. The leg exerciser 38 can be adjusted for position so that a person sitting in the seat 25 may remove his feet from the footrest 27 and place them on the leg exerciser 38 bar 40 and then use his legs to push the U-shaped swing portion 22 with the user sitting therein back and forth to exercise the legs. The A-frame section 12 is made of a U-shaped tubing 44 and has a square channel member 45 therein with an aperture 46 for sliding an attachment thereinto so that an additional piece of exercise equipment can be attached thereto for exercising the legs, such as a peddling exerciser.

The exerciser 10 of the present invention advantageously is lightweight and simplified by the user using his own weight as a resistive mass. It may be folded, as seen in FIG. 3, from the open position of FIGS. 1 and 2 to the folded position of FIG. 3 by simply releasing the locking links 18 folding the A-frame sections 11 and 12 together. This allows the seat 25, having the foot support 27 and back support 26 folded, to fold. The arms ace rotated to allow for one convenient folded package which can be easily carried by one person to any location desired or packed within a vehicle for easy transportation. It also allows the exerciser to be packed for shipping and storage.

Figure 4:
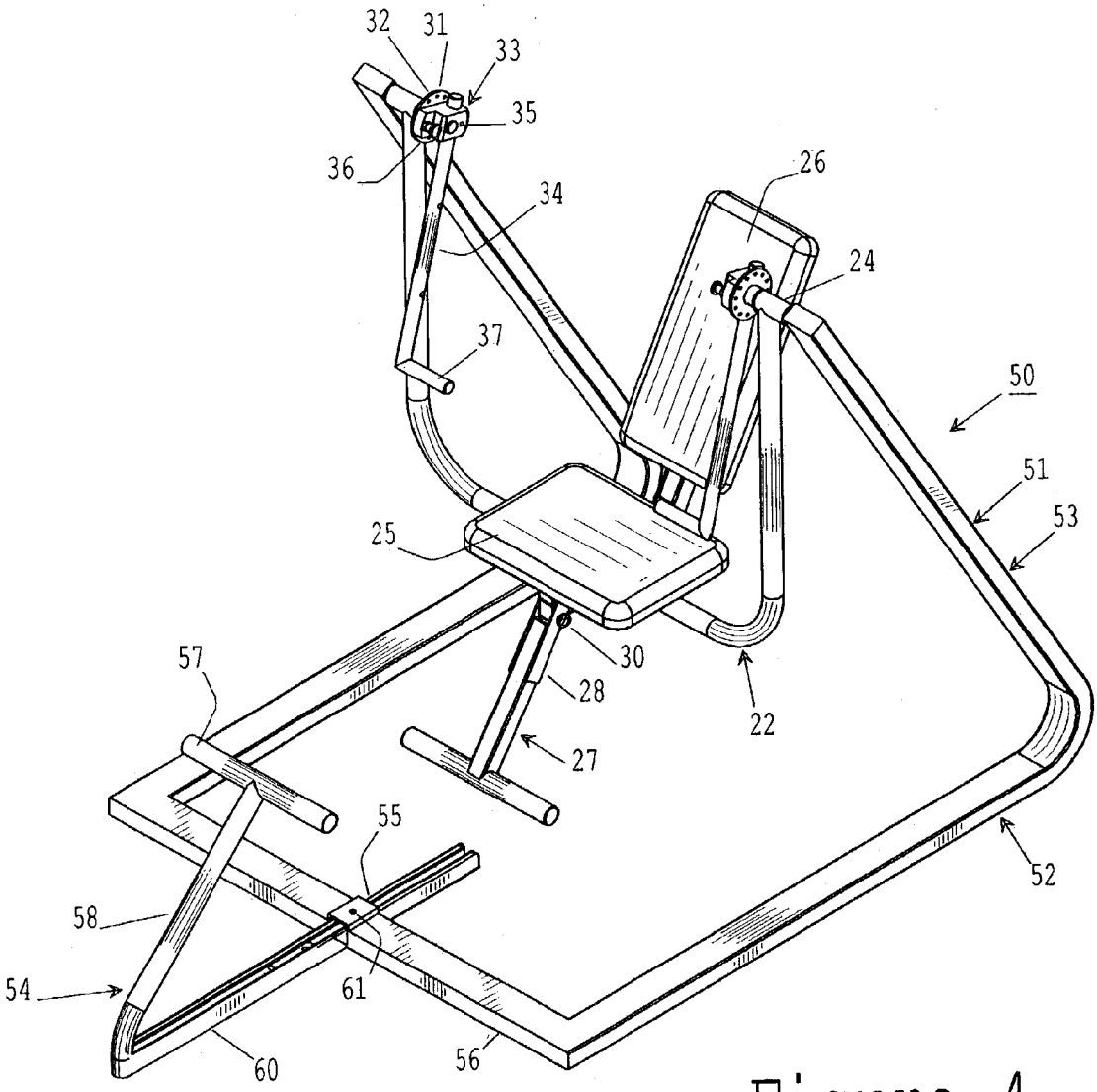
FIG. 4 is a perspective view of an alternate embodiment of an exerciser in accordance with the present invention.

Turning to FIG. 4, an alternate embodiment 50 of the exerciser of FIGS. 1–3 is illustrated having the identical U-shaped swing portion 22 having the seat 25 mounted thereon and having the foot support 27 and back support 26. The exerciser 50 also has the arms 34 with the handles 37 mounted with the bracket 33 mounted to a rod 35 and connected to the disc 31 having apertures 32 and a locking pin 36. In this embodiment, the U-shaped swing portion 22 is mounted to a fixed A-frame 51 which has been turned on its side to provide for a base frame portion 52 and an angled upright frame portion 53. The frame base portion 52 has a foot exerciser 54 mounted in a square channel 55 mounted in the front frame member 56 of the base frame 52. The foot exerciser 54 has a foot supporting member 57 forming a tee on the member 58 which is attached to a square channel-like member 60 which slides and is locked into the square channel 55 to hold it in position. A locking pin 61 passing through the locking channel sleeve 55 allows the locking of the foot rest 57 in place. The frame 51 in this embodiment is formed from a channel rather than a tubular frame and may be made of a metal, such as steel. Similarly, the frame of FIGS. 1–3 can be made of a steel tubing or any other material desired that is sufficiently strong to support the user.

It should be clear at this time that an exerciser has been provided which allows the user to exercise the arms and the legs and which utilizes the user's own weight as a load to thereby simplify the exerciser and which can be easily moved between positions and easily folded for storage or shipping. It can be rapidly set up for use in the home. However, the present invention should not be considered as limited to the forms shown which are to be considered illustrative rather than restrictive.

I claim:

1. An exercise apparatus comprising:

a folding A-frame formed from two generally U-shaped frame sections hinged together, said hinged frame sections being foldable on said hinge from a folded storage position to an open operative position;

a generally U-shaped swing portion having two end portions movably attached to one said frame section and having a seat attached thereto; and a pair of arms, each said arm being independently angularly adjustably attached about an axis to one said generally U-shaped frame section and extending radially therefrom to thereby vary the angular position of each arm independently relative to said generally U-shaped frame section; and each said arm having a handle portion thereon, whereby a person sitting in said generally U-shaped swing portion seat and pushing or pulling on said handles can move said generally U-shaped swing portion and person sitting therein relative to said A-frame to thereby exercise the person's arms and upper body.

2. The exercise apparatus in accordance with claim 1 including a leg exerciser attached to one said frame section and positioned for a person seated in said seat on said generally U-shaped swing portion to exercise the legs, whereby a folding arm and leg exerciser apparatus utilizes a person's own mass for exercising the arms and legs.

3. The exercise apparatus in accordance with claim 2 in which said hinged frame sections have at least one locking link to lock said frame sections in an open operative position.

4. The exercise apparatus in accordance with claim 1 in which said seat has an adjustable back supporting member mounted thereto.

5. The exercise apparatus in accordance with claim 4 in which said generally U-shaped swing portion seat has a foot supporting member mounted thereto.

6. The exercise apparatus in accordance with claim 2 in which said leg exerciser includes a bar adjustably attached to one said U-shaped frame section allowing a person's feet to be placed thereon while seated in said seat and to push said U-shaped member, seat and person to exercise the person's legs.

7. The exercise apparatus in accordance with claim 5 in which said foot support is removably attached to said seat.

8. An exercise apparatus comprising:

a frame having a base frame portion and an angled upright frame portion;

a generally U-shaped swing portion having two end portions and being movably attached to said angled upright frame section and having a seat attached thereto;

a pair of arms, each said arm being independently angularly adjustably attached about an axis to one said generally U-shaped frame section and extending radially therefrom, each said arm having a handle portion thereon, whereby a person can independently adjust the angular position of each said arm independently relative to the U-shaped frame portion and can sit in said generally U-shaped swing portion seat and grip said handles to push or pull said generally U-shaped swing portion and person sitting therein relative to said frame to thereby exercise the person's arms; and a leg exerciser attached to said base frame section and positioned for a person seated in said seat on said generally U-shaped swing portion to exercise the legs while exercising the arms, whereby an arm and leg exerciser apparatus utilizes a person's own mass for exercising the arms and legs.

9. The exercise apparatus in accordance with claim 8 in which said seat has a back supporting member attached thereto.

10. The exercise apparatus in accordance with claim 9 in which said generally U-shaped swing portion seat has a foot supporting member attached thereto.

11. The exercise apparatus in accordance with claim 10 in which said leg exerciser is a bar adjustable attached to said base frame portion allowing said feet to be placed thereon while a person is seated in said seat and to push said U-shaped swing portion, seat and person to exercise said legs.

12. The exercise apparatus in accordance with claim 11 in which said foot support is removably attached to said seat.

* * * * *